US005338113A

United States Patent [19]

Fissenko

[11] Patent Number: 5,338,113

[45] Date of Patent: Aug. 16, 1994

[54] METHOD AND DEVICE FOR PRESSURE JUMPS IN TWO-PHASE MIXTURES

[75] Inventor: Vladimir Fissenko, Moscow, U.S.S.R.

[73] Assignee: Transsonic Uberschall-Anlagen GmbH, Munich, Fed. Rep. of Germany

[21] Appl. No.: 895,290

[22] Filed: Jun. 8, 1992

Related U.S. Application Data

[63] Continuation-in-part of Ser. No. 755,050, Sep. 5, 1991, Pat. No. 5,205,648.

[51] Int. Cl.[5] ..... B01F 15/02; B01F 5/02

[52] U.S. Cl. ..... 366/177; 137/606; 137/889; 366/349

[58] Field of Search ..... 366/348, 349, 163, 108, 366/116, 127, 177; 137/606, 889, 3; 68/3, 55; 134/1, 184

[56] References Cited

U.S. PATENT DOCUMENTS

| | | | |
|---|---|---|---|
| 3,200,764 | 8/1965 | Saunders | 417/185 |
| 4,416,610 | 11/1983 | Gallagher | 137/889 |
| 4,569,635 | 2/1986 | Nicodemus | 417/196 |
| 4,738,541 | 4/1988 | Weber | 366/163 |
| 4,781,467 | 11/1988 | Williams | 137/889 |

FOREIGN PATENT DOCUMENTS

WO/8910184 11/1989 PCT Int'l Appl. .

OTHER PUBLICATIONS

Brochure issued by *Helios Research Corporation* entitled "*HelioJeT TM Fixed Flow System*" (undated).

Brochure issued by *Helios Research Corporation* entitled "*HelioJET TM Central Cleaning System*" (undated).

Brochure issued by *Transsonic* entitled "*Introducing The Transsonic Pump*" (undated).

*Primary Examiner*—Robert W. Jenkins

*Attorney, Agent, or Firm*—Pennie & Edmonds

[57] ABSTRACT

An improved device for acting upon fluids by means of a pressure jump is disclosed. The device consists of a nozzle which receives an active fluid. A passive fluid is provided to the nozzle such that it mixes with active fluid to form a two-phase mixture flowing with subsonic velocity. The passive fluid when mixed with the active fluid partially evaporates thereby increasing the stagnation pressure of the mixture and decreasing its stagnation temperature. An expansion chamber is joined with the nozzle where the two-phase mixture is accelerated. An outlet channel with constant cross-sectional area is connected to the expansion chamber. In the outlet channel, the mixture is accelerated to its supersonic velocity so as to create a pressure jump. The nozzle of the device comprises at least one working section and at least one control section. In the working section, the passive fluid is provided into the flow of the active fluid to create a two-phase mixture. In the control section, which is joined with the expansion chamber, additional mass is provided to the flow of the two-phase mixture so as to adjust the ratio of gas and liquid phases in the mixture for achieving a pressure jump of the desired intensity in the outlet channel.

27 Claims, 6 Drawing Sheets $$\beta = \frac{V(\text{GAS})}{V(\text{GAS}) + V(\text{liquid})}$$

$$X = \frac{M(\text{GAS})}{M(\text{GAS}) + M(\text{liquid})}$$

METHOD AND DEVICE FOR PRESSURE JUMPS IN TWO-PHASE MIXTURES

RELATED APPLICATION

This Application is a continuation-in-part of U.S. patent application Ser. No. 07/755,050; filed on Sep. 5, 1991, now U.S. Pat. No. 5,205,648 (hereinafter the parent application).

FIELD OF THE INVENTION

This invention relates to a pressure jumps in multiphase fluids. Such fluids can be liquids gases and vapors and may include solid particles dispersed therein. In particular, this invention relates to pressure jumps in two-phase fluids.

BACKGROUND OF THE INVENTION

In the parent application, which is incorporated in its entirety herein by reference, there is described a method and device for accelerating a two-phase mixture of at least two fluids moving with subsonic velocity to sound velocity, then accelerating it to supersonic velocity such that the mixture is brought to a final pressure through a pressure jump (or shock wave) substantially as a one-phase mixture.

One of the fluids in the two-phase mixture is referred to as an "active" fluid, and the other fluid is referred to as a "passive" fluid. Typically, but not always, the active fluid is gas that supplies energy for transporting the passive fluid, which is a liquid.

The apparatus disclosed in the parent application takes advantage of the physical phenomenon of an enhanced compression in homogenous two-phase flows or mixtures. In such mixtures, the sound velocity is lower than in either only the liquids or gases (vapors).

The compressibility of a flowing medium is represented by Mach number, denoted as "M," which corresponds to the ratio of flow speed and of the local sound velocity in the flowing fluid or fluid mixture. Since in the homogeneous two-phase mixtures, the sound velocity is very low, it is possible to achieve supersonic effects in such mixtures (with M greater than 1) by applying relatively low energy.

The increase of the Mach number is obtained in conventional jets or turbines by increasing the flow velocity, i.e., by increasing the numerator of the Mach number ratio. With the apparatus disclosed in the parent application a supersonic effect is obtained by lowering the sonic speed of the Mach ratio. This allows reducing the expenditure of energy for achieving the supersonic effects in comparison with conventional systems. Note also that the intensity of a shock wave (pressure jump) is proportional to the square of the Mach number, i.e. the ratio of the pressure at the rear of the shock wave and of the pressure in front of the shock wave is proportional to the square of the Mach number.

The apparatus described in the parent application comprises a nozzle coaxially connected to a feed line for mixing at least two fluids. An expansion chamber is provided downstream of the narrowest cross-sectional area at the outlet side of the nozzle. An outlet channel having a constant cross-sectional area is connected to the expansion chamber. The hydraulic diameter of constant cross-sectional area of the channel is as great as or up to three times as great as the hydraulic diameter of the narrowest cross-sectional area of the nozzle. Also, an outlet is connected with the expansion chamber and provided with a relief valve.

In this apparatus the static pressure $P_{ck}$ in the rear of the shock wave is adjusted such that it is greater than the static pressure $P_l$ in front of the shock wave and is less than the half of the sum of the static pressure $P_l$ in front of the shock wave and of the stagnation pressure $P_o$ in the rear of the shock wave or is equal to the half of this sum.

It is possible to achieve the desired fluid action substantially independently of changes of the outside pressure and end pressure. A stable operation with constant flow rates of the fluids in this device is obtained if the outer pressure or end pressure $P_{np}$ is greater than the static pressure $P_l$, in front of the shock wave but less than the static pressure $P_{ck}$, in the rear of the shock wave or is equal to this pressure $P_{ck}$, wherein within these pressure ranges the pressure of the two-phase mixture expanded to its supersonic velocity is not released.

There are certain drawbacks associated with the apparatus disclosed in the parent application. First, the proper ratio of fluids in the mixture and the pressure jump is achieved due to the geometric design of the system. Thus, the apparatus typically can handle only the fluids having relatively inflexible parameters, such as pressure and temperature. If the parameters of the fluids and/or the environment at the outlet of the system change, then a new apparatus would need to be designed and built.

Furthermore, the apparatus disclosed in the parent application is unable to create a stable pressure jump if the temperature of the passive fluid is higher than the temperature of the active fluid, or the temperatures of both fluids are approximately the same. Under such conditions gas condenses so that it is difficult to maintain a proper ratio of the gas and liquid phases in the mixture such that the sonic velocity of the mixture is reduced as required for a stable pressure jump. Also, the condensation of the active fluid causes the decrease of the stagnation pressure of the mixture. The stagnation pressure determines the intensity of the pressure jump.

As indicated, in the apparatus disclosed in the parent application, the intensity of the pressure jump is determined by the geometrical dimensions of the device and the parameters of the fluids. However, such a device does not provide a facility for varying the intensity of the pressure jump. I have invented a device which overcomes the disadvantages and limitations of the aforementioned apparatus.

SUMMARY OF THE INVENTION

According to the present invention, an improved device for acting upon fluids by means of a pressure jump is provided. The device consists of a nozzle which receives an active fluid. The passive fluid is provided to the nozzle such that it mixes with active fluid to form a two-phase mixture flowing with subsonic velocity. The passive fluid when mixed with the active fluid partially evaporates thereby increasing the stagnation pressure of the mixture and decreasing its stagnation temperature.

An expansion chamber is joined with the nozzle where the two-phase mixture is accelerated. An outlet channel with constant cross-sectional area is connected to the expansion chamber. In the outlet channel, the mixture is accelerated to its supersonic velocity so as to create a pressure jump.

The nozzle of the device comprises at least one working section and at least one control section. In the working section, the passive fluid is provided into the flow of the active fluid to create a two-phase mixture. In the control section, which is joined with the expansion chamber, additional mass is provided to the flow of the two-phase mixture so as to adjust the ratio of gas and liquid phases in the mixture for achieving a pressure jump of the desired intensity in the outlet channel.

Since by adding mass in the control section the concentration of the phases can be controlled, the device of the present invention can be adjusted to produce a stable pressure jump of the desired intensity for the liquids having varying parameters without modifying the geometrical dimensions of the device.

The nozzle employed in this invention is a so-called "consumption" nozzle. As a conventional geometrical nozzle, this nozzle is employed for converting potential energy into kinetic energy of the flow. More specifically, potential energy of pressure at the inlet of the consumption nozzle is converted into kinetic energy by adding mass in a subsonic fluid flow or by removing mass in the supersonic flow. Thus, in a consumption nozzle having a constant cross-section, it is possible to accelerate the fluid to its sonic velocity by adding mass to the flow and then to achieve supersonic velocity by removing mass from the flow.

In the nozzle of this invention, the passive fluid is provided to the flow of the active fluid such that the stagnation pressure of the resultant mixture is increased and its stagnation temperature is decreased. Also other fluids can be provided to increase the stagnation pressure. Thus, the intensity of the pressure jump is enhanced by supplying mass and/or heat to the still on-phase fluid mixture or already two-phase fluid mixture flowing with subsonic velocity before coming to its sound velocity.

There are known devices where the stagnation temperature of gas flow is reduced by introducing liquid in the flow. In a snow cannon, for example, snow is made by introducing water into the flow of gas, even though both water and gas have temperatures above zero. This phenomenon takes place because in a consumption nozzle a liquid evaporates thereby lowering the stagnation temperature of the flow and increasing its stagnation pressure. This phenomenon, however, has not been utilized for increasing the intensity of a pressure jump in a homogeneous two-phase mixture of fluids.

Thus, the object of the present invention is to provide an apparatus which achieves a considerable and controllable pressure jump in a two-phase fluid without the drawbacks associated with the invention of the parent application.

BRIEF DESCRIPTION OF THE DRAWINGS

The present invention is described in detail below with reference to the drawings wherein.

DETAILED DESCRIPTION OF THE INVENTION

In the description which follows, any reference to either direction or orientation is intended primarily and solely for purposes of illustration and is not intended in any way as a limitation of the scope of the present invention. Also, the particular embodiments described herein, although being preferred, are not to be considered as limiting of the present invention. Furthermore, like parts or elements in the various drawings hereto are generally identified by like numerals for ease of reference.

As discussed above, the sound velocity in two-phase homogeneous flows (i.e., flows comprising a mixture of a gas and a liquid) is considerably slower than the speed of sound in a pure gas or a pure liquid. Accordingly, a two-phase mixture is more compressible than pure gas.

Also as described previously, the ratio of the fluid pressures in a flow (at the inlet and at the outlet of the device through which the flow passes) is proportional to the velocity of the fluid and inversely proportional to its intrinsic speed of sound. This invention as an improvement of the invention disclosed in the parent application, which is incorporated herein by reference, provides that a pressure jump can be achieved not only by increasing the velocity of the flow, but also by controlling the consistency of a two-phase mixture so as to reduce the sonic velocity in the mixture. The pressure jump occurs when the velocity of the flow becomes higher than its sonic velocity.

Figure 1:
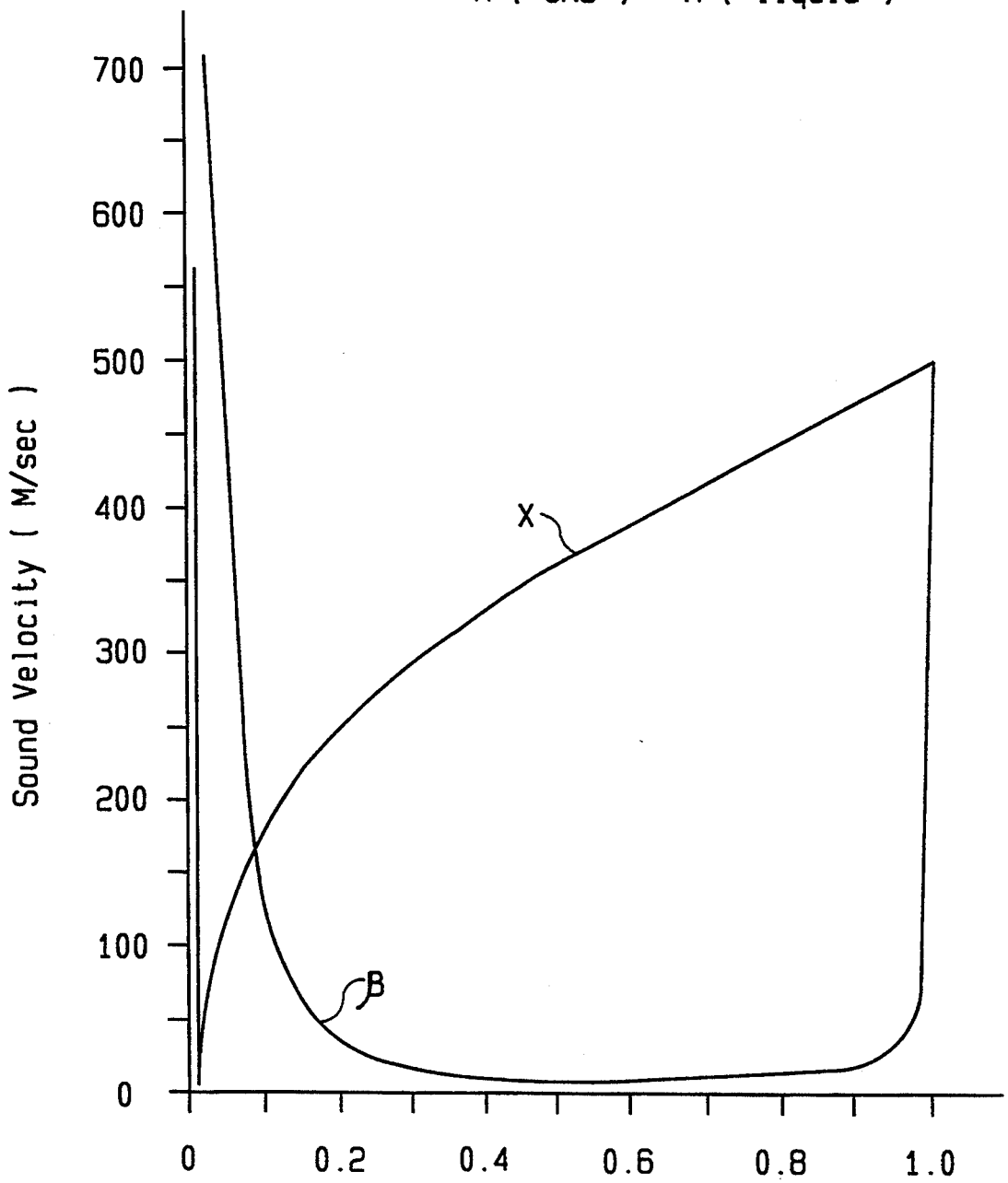
FIG. 1 is a graph that shows a sound velocity in the gas and liquid mixture as a function of $X=M_g/(M_g+M_l)$ where $M_g$ is the mass of gas and $M_l$ is the mass of liquid in the mixture and as a function of $\beta=V_g/(V_g+V_l)$, where $V_g$ is the volume of gas and $V_l$ is the volume of liquid in the mixture.

FIG. 1 illustrates the dependency between the speed of sound in a flow of a two-phase mixture and the proportion of gas and liquid in the mixture. The vertical axis on FIG. 1 indicates the speed of sound in the two-phase mixture and the horizontal axis indicates the proportion of gas and liquid in the mixture. More specifically on the horizontal axis at the origin 0, the fluid is entirely liquid and not gas, and at 1 it is gas only. The values in between show the proportion of gas and liquid in a homogenous two-phase substance. The curve denoted by $\beta$ shows sonic velocity in the mixture as a function of the volume ratio of the gas and the mixture of gas and liquid phases, i.e., $\beta=V_g/(V_g+V_l)$ where $V_g$ is the volume of gas and $V_l$ is the volume of liquid in the mixture. The curve X shows speed of sound in the mixture as a function of the mass ratio of gas and the mixture of gas and liquid phases, i.e. $X=M_g/(M_g+M_l)$, where $M_g$ is the mass of gas and $M_l$ is the mass of liqud in the mixture. Thus, for the curve $\beta$, the horizontal axis indicates the proportion of the volumes and for the curve X, the horizontal axis indicates the proportion of the masses of the gas and liquid phases.

Considering the curve $\beta$, we notice that when the volumes of gas and liquid phases in the mixture are approximately equal, the speed of sound in the two-phase mixture is minimized. Thus, when the value of $\beta$ is approximately equal to 0.5 the intensity of the pressure jump is maximized. In the parent application, the value of $\beta$ close to 0.5 was achieved by controlling the geometries of the fluid flow in the device of the parent application.

It has been determined, however, that since in the parent application the appropriate value of $\beta=0.5$ for producing the pressure jump was achieved by selecting the geometric features of the system, it was difficult if not impossible to adjust the apparatus of the parent application for changing input parameters. Furthermore, due to the fixed geometry of that device the intensity of the pressure jump was not adjustable.

In the present invention, the ratio of the phases required for achieving the pressure jump is controlled not solely by the geometrical characteristics of the flow, but also by providing additional mass and/or heat into the flow.

Referring to the curve X on FIG. 1, it depicts the relationship between the speed of sound in a two-phase mixture and the proportion of mass of liquid and gas phases in the mixture. Note that when the mass of gas is very low the speed of sound in the mixture is minimized. In particular, the minimum sonic velocity is generally achieved when the proportion of masses is approximately 0.000131. At this point, the speed of sound in the flow is at least as low as when the proportioning of the volumes ($\beta$curve) is 0.5. Thus by controlling the ratio of masses of gas and liquid phases, it is possible to control the value of $\beta$ so as to minimize the speed of sound in the flow for achieving the desired intensity of the pressure jump.

Figure 2:
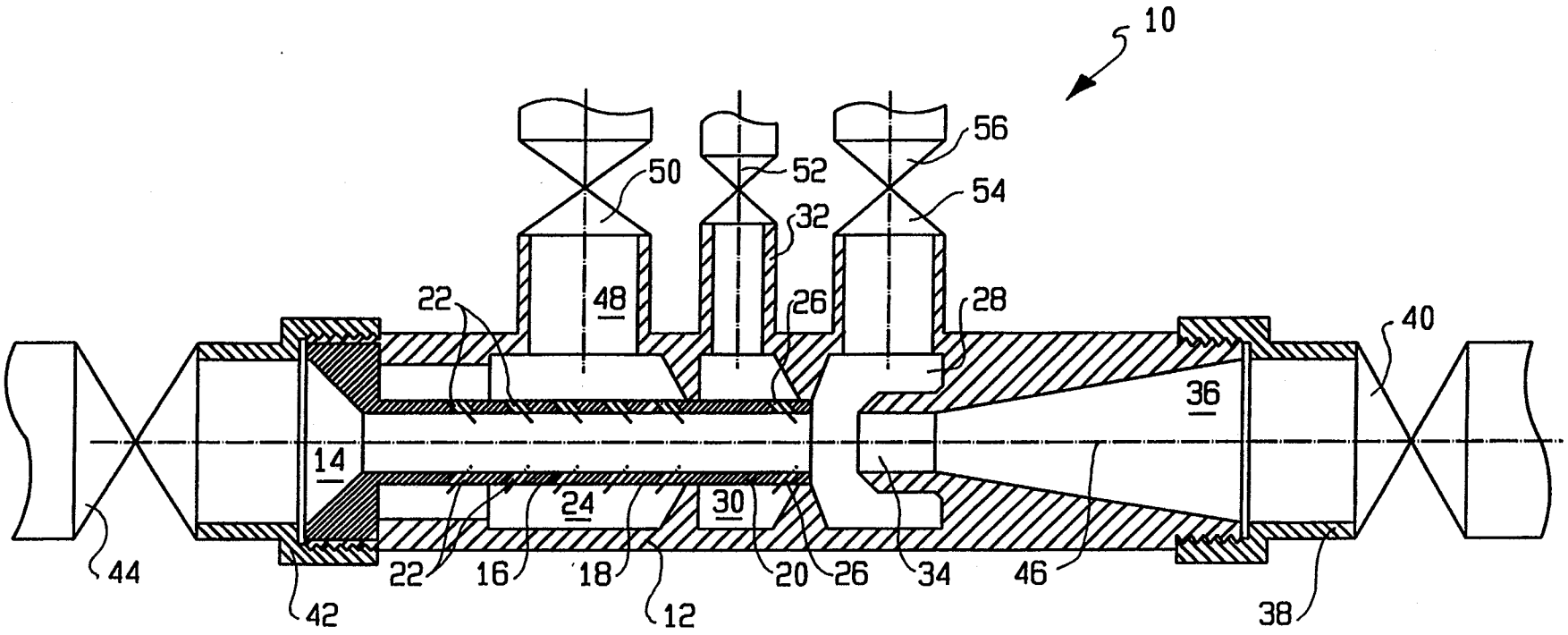
FIG. 2 is a cross-sectional view of a device according to the present invention taken along the longitudinal axis of the device.

As shown in FIG. 2, the device 10 of the present invention, has a cylindrical housing 12 with a converging inlet opening 14. As discussed subsequently, the geometry of the inlet portion 14 can be modified according to the properties of the fluids. The narrowest cross-section of the inlet 4 is joined to a cylindrical "consumption" nozzle 16. As indicated previously, in a consumption nozzle, if mass is supplied when the velocity of fluid flow is lower than the speed of sound in the fluid or mass is removed when the speed of the flow is higher than the speed of sound, the potential energy of pressure is converted to kinetic energy.

The nozzle 16 contains a working or mixing section 18, and a control section 20. As described subsequently in the alternative embodiments of the device 10 of the present invention, the geometry of the working or mixing section 18 can be modified. The walls of the working or mixing section 18 have perforations 22. The number, size and orientation of the perforations or holes 22 is determined by the desired proportion of the active and passive fluids and the desired fluid temperature, pressure and concentration at the outlet of the device 10. The mixing of an active and a passive fluid takes place in the main mixing chamber 24. The control section 20 contains one or more openings 26 for providing additional predetermined amounts of mass and/or heat into the fluid flow to adjust the consistency of the resultant mixture (i.e, the value of $\beta$) for the desired intensity of the subsequent pressure jump.

The control section 20 is joined with an expansion chamber 28. A separation chamber 30 separates the control section 20 from the expansion chamber 28 and from the working section 18. To control $\beta$, and thus the intensity of the pressure jump, one or more additional fluids are provided to the chamber 30 via feed line 32. These additional fluids are provided to the flow in the nozzle 16 via the opening(s) 26. The distance from the feed line 32 to the point where the nozzle 16 is joined with the expansion chamber 28 is approximately one radius of the nozzle 16.

In an alternative embodiment of the present invention, the nozzle 16 may have a plurality of working sections 18 and/or a plurality of control sections 20. Generally, the portion of this device 10 located to the right of the chamber 28 is identical to the apparatus disclosed in the parent application.

A cylindrical outlet channel 34, having a substantially constant cross-sectional area, is joined to the expansion chamber 28 opposite to the control section 20 of the nozzle 16. It is desirable for the edges at the transition from the expansion chamber 28 to the channel 34 to be smooth. A diffuser passage 36 is joined co-axially to the cylindrical outlet 34.

On the outlet side of the diffuser passage 36, a cylindrical outlet socket 38 provided with a slide valve 40 is screwed by means of a threading connector with the housing 12. The outlet socket 38 has a constant cross-sectional area with a diameter preferably equal to the outlet diameter of the diffuser passage 36. An inlet socket 42 that is provided with a slide valve 44 is screwed on the opposite end of the housing 12 by means of a threading connection. The cross-sectional area of the inlet socket 42 corresponds to that of the largest diameter of the inlet opening 14.

The inlet opening 14, the nozzle 16, and separation chamber 30, the mixing chamber 24, the expansion chamber 28, the outlet channel 34, and the diffuser passage 36 are all disposed in rotational symmetry with regard to the cylindrical housing 12 and in co-axial alignment in relation to its axis 46. The inlet socket 42 as well as the outlet socket 38 are also arranged co-axially with respect to the axis 46.

At least one fluid feed line 48, provided with a slide valve 50, opens radially in the area of the working section 18 of the nozzle 16. At least another fluid feed line 32 having a slide valve 52 is directed towards or fluidly coupled with the control section 30 of the nozzle 16. An outlet socket 54 with a relief valve 56 opens radially into the expansion chamber 28.

The device 10 of the present invention can be manufactured from any material that would withstand the pressures, temperatures and other conditions required by a particular application. The inner surfaces of the device 10 should be substantially smooth so as to not interfere with the fluid flows therein.

In summary, the device 10 of the present invention operates as follows. A first fluid component or an active fluid is supplied at the inlet 42 and then is mixed with a second fluid component or a passive fluid provided to the working area 18 of the nozzle 16 via the feedline 48. After the active and passive fluids are mixed, the velocity of the mixture becomes subsonic, even if the active fluid was supplied with a supersonic velocity. Also after the fluids are mixed the stagnation temperature of the mixture is decreased and its stagnation pressure is increased. In the control section 20, another one or more fluids are supplied so as to adjust the mixture's $\beta$ for the desired intensity of the pressure jump. In the expansion chamber 28, the fluids are accelerated such that they reach supersonic velocity in the outlet 34 where the pressure jump of the desired intensity occurs.

Figure 3:
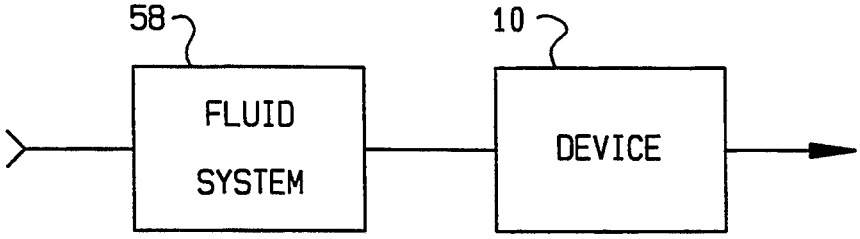
FIG. 3 is a schematic block diagram of a system incorporating the device of FIG. 2.

More specifically as shown in FIG. 3, the device 10 of the present invention is typically connected or fluidly coupled to a fluid system that requires at the outlet of the device a mixture of fluids with the desired characteristics, such as pressure, temperature, and concentration. Initially, in the system 58 that incorporates the device 10, the valves 52, 50, 44 and 40 are closed. The system 58 is activated by opening the valves 50 and 40, whereby the second fluid component or passive fluid is passed through the feed line 48 and through the perforations 22 in the walls of the working section 18 of the nozzle 16. From the nozzle 16 the fluid is provided to the expansion chamber 28. If the counter or back pressure in the system 58 (i.e. the pressure at the outlet 38) is greater than the pressure in the expansion chamber 28, relief valve 56 of an outlet socket 54 opens.

The valve 56 closes after the active fluid is provided by opening the slide valve 44. In the working section 18 of the nozzle 16 the active and passive fluids mix. From the nozzle 16 the mixture is provided to the expansion chamber 28 and then to the cylindrical outlet channel 34, diffuser passage 36 and cylindrical outlet socket 38 and the opened slide valve 40.

The same passive fluid (and/or other fluids) is also provided via feedline 32 to the separation chamber 30 and then to the control section 20 of the nozzle 16 via the opening(s) 26. More specifically, at a distance which is approximately a radius of the nozzle before the expansion chamber the pressure of the mixture drops to the pressure of the system and at that point additional fluid(s) are provided. In the control section the added fluid(s) are mixed with the main fluid flow in the nozzle.

By adjusting the valve 52, the supply of the additional fluid(s) through that valve is controlled so as to ensure the proper ratio of the phases of fluids in order to achieve a pressure jump of the required intensity. As indicated the intensity of the pressure jump is determined by the value of $\beta$. Thus, if it is necessary to change the intensity of the pressure jump during the stable operation of the device, the temperature or pressure of the fluids in the separating chamber 30 can be changed by adjusting the valve 52, i.e by changing the supply of the additional mass. In the control section or chamber 20 the pressure of the mixture drops because mass is added into the flow and the pressure of the flow is employed for accelerating the mixture.

According to the present invention, the proper consistency of the mixture required for achieving the pressure jump is produced in the control section 20 and working section 18 of the nozzle 16, which replaced the conically tapered nozzle and the diaphragm of the invention set forth in the aforementioned parent application. As discussed previously, the apparatus of the parent application employed the geometric properties of the apparatus to achieve the pressure jump. Since the geometry of the manufactured apparatus cannot be changed, an unstable condition, i.e. a condition when the pressure jump sometime does not occur, may arise when the velocity of the flow is approximately the same as the speed of sound in the flow due to a misadjusted value of $\beta$.

However, in the device 10 of the present invention, the value of $\beta$ can be controlled so as to maintain a stable pressure jump of the desired intensity. In the present invention, when the value of $\beta$ becomes too large, cool fluid can be added to the control section 20 to stabilize the jump. If $\beta$ becomes too low, its value can be increased by adding a hot fluid into the flow. Thus, according to the present invention, even if the input parameters differ from the parameters for which the device 10 was designed, the device 10 can be adjusted for stable operation, which was impossible in the apparatus described in the parent application.

The operation of the device 10 of the present invention is illustrated in the examples discussed below in connection with FIGS. 4, 5, 6 and 7. In each of these Figures, the device 10 is illustrated schematically. The corresponding flow velocity W and the static pressure P of the fluids (or the mixture) are illustrated in the axal direction of the device 10.

Figure 4:
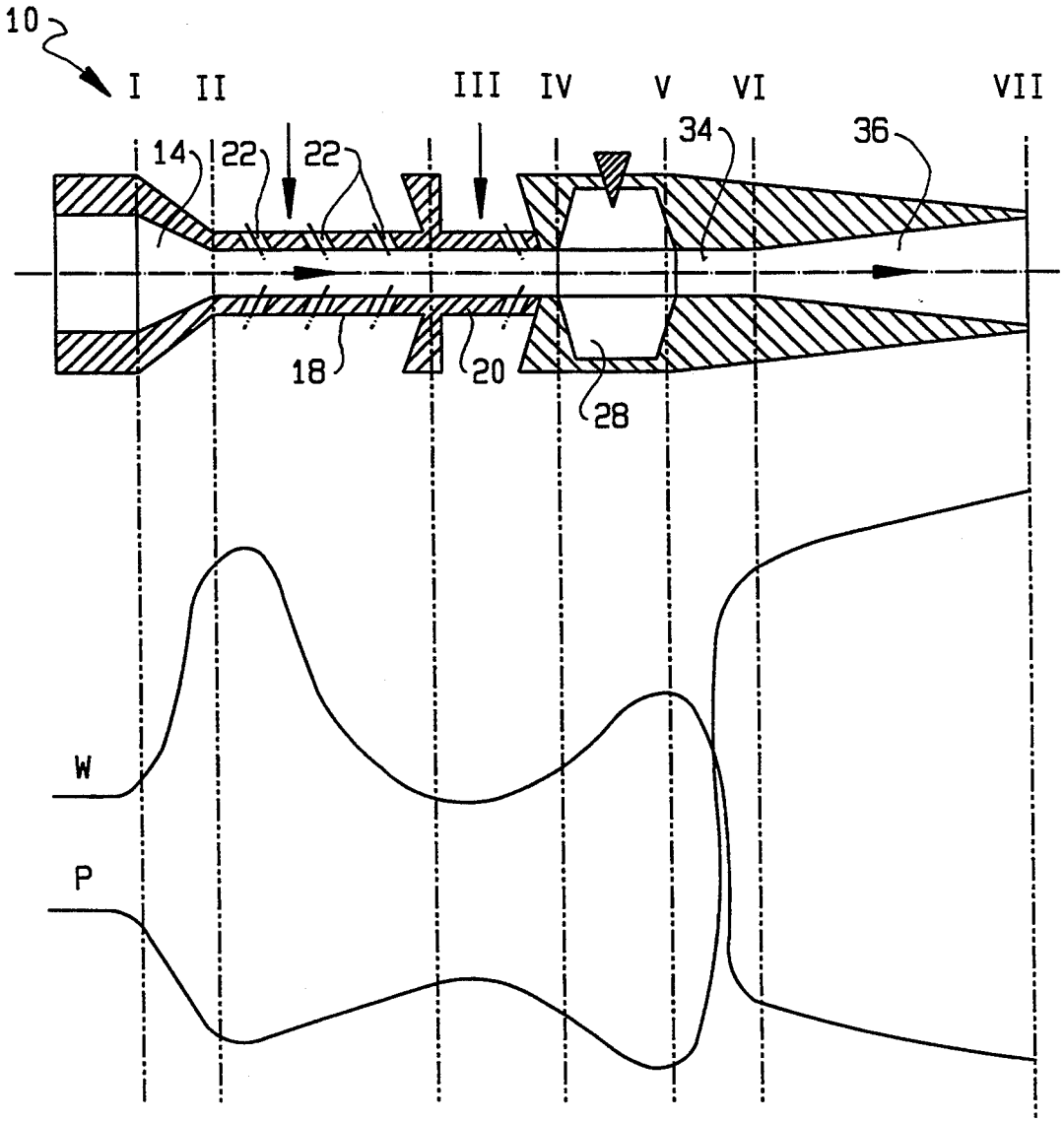
FIG. 4 is a cross-sectional schematic view of the device of FIG. 2 and corresponding W and P curves.

In FIG. 4, the first example illustrates the operation of the device 10 of this invention in a system 58 for heating of buildings and structures with hot water. In a tall building, where the pressure of water circulating in the building is high, to conserve energy, the pressure of steam employed for circulating the water should be lower than the pressure of water. Thus, such a system 58 requires that the pressure of steam (active fluid) at the inlet of the device is lower than the pressure of water (passive fluid) in the system 58. In other words, the pressure of the active fluid at the inlet 42 is less than the pressure of the passive fluid provided via the feed line 48 and the pressure of hot water (the resultant mixture) at the outlet 38 should be maintained several times higher than the pressure of steam (active fluid) at the inlet 42. Also in such a system 58, the pressure at the outlet 38 should be higher than the pressure of water in the building (i.e., the pressure at the feedline 48) by the value approximately equal to the friction and local resistance of the system 58.

The operation of the system 58 under the conditions described above is illustrated in FIG. 4. The device 10 is illustrated schematically. The velocity of the flow W and the static pressure P are illustrated below the device 10. In this illustration of FIG. 4, the opening 14 is located between the cross-sections I and II, the working section 18 of the nozzle 16 is located between the cross-sections II and III, the control section 20 is between the cross-sections III and IV, the expansion chamber 28 is between the cross-sections IV and V, the channel 34 is between the cross-sections V and VI and the passage 36 is between the cross-sections VI and VII.

The pressure of steam provided at the inlet 14 is lowered between the cross-sections I and II, where the flow path narrows. Consequently, the velocity of steam increases in this interval. As well known, when the flow path narrows, the velocity of a fluid flow increases and its pressure and temperature decrease.

The passive fluid is mixed with the active fluid in the working section 18 of the nozzle 16 between the cross-sections II and III. After mixing with active fluid in the initial zone of the working section 18 of the nozzle 16 (where the pressure of the active fluid has been reduced), the passive fluid partially evaporates (boils). Also in this region of the nozzle 16 where the pressure has been lowered, the heat exchange and the exchange of the speed components of the active and passive fluids takes place.

Due to the evaporation of the passive fluid, additional steam is created thereby increasing the amount of the active fluid. Since evaporation converts heat into the kinetic energy of the flow, the kinetic energy of the flow and its stagnation pressure increase, and the stagnation temperature of the flow is decreased. Thus, the passive fluid also supplies energy into the fluid flow and contributes to the increase of the stagnation pressure of the flow.

During the further motion of the mixture in the working section 18 of the nozzle 16, the passive fluid is continuously provided through the perforations 22 in the walls of the working section 18, thereby increasing the pressure of the mixture (due to the evaporation), and decreasing the velocity of the flow. The velocity of the flow becomes homogenous throughout the cross-section of the nozzle 16 approximately at the cross-section IV, prior to the point where additional fluid(s) can be provided from the separation chamber 30.

In the control section 20 of the nozzle 16 located between the cross sections III and IV, an additional passive fluid and/or one or more other fluids can be supplied into the flow. These additional fluid(s) are supplied so as to create a two-phase mixture which has the appropriate or desired proportion of gas and liquid for the desired intensity of the subsequent pressure jump. To intensify the jump the value of $\beta$ has to be reduced. As illustrated in FIG. 1 the proportion of the masses X of gas and liquid effects the value of $\beta$ (the proportion of the volumes). Thus, the amount and the temperature of the additional fluid added between the cross sections III and IV is selected so as to adjust the value of $\beta$ for the stable pressure jump of the desired intensity. The selection of the appropriate parameters is apparent from FIG. 1.

Note that the feedline 32 of the control section 20 can be connected via a valve (not shown) to receive fluids from the feedline 48 or from the outlet 40. For example, if $\beta$ in the area of the cross section VI is greater than desired, then to lower the volume of steam, a fluid, which is cooler than the fluid at the outlet of the system, can be supplied from the feed line 48 into the feed line 52. If it is necessary to supply hot fluid to increase $\beta$, feedline 52 can be connected to the outlet 40.

The mixture moves along the nozzle 16, i.e., from the cross-section II to the cross-section IV with a velocity which is lower than its intrinsic velocity of sound since, after the passive fluid is introduced, the intrinsic velocity of sound of the mixture drops lower than the velocity of the fluid flow. This is significant since in a "consumption" nozzle, if mass is supplied when the velocity of the fluid flow is lower than the velocity of sound in the fluid, the potential energy of pressure is converted into kinetic energy. As noted, the movement of the fluid along the nozzle 16 causes the decrease of the stagnation temperature and therefore the increase of the stagnation pressure.

After the cross-section IV, in the expansion chamber 28, due to the expanded cross-section of the flow, the pressure of the mixture and the intrinsic speed of sound are lowered due to the evaporation of the fluid. After the cross-section IV the velocity of the flow increases such that between the cross-sections V and VI in the channel 34, the speed of the flow becomes higher than the speed of sound in the mixture. For this reason the pressure jump occurs between the cross-sections V and VI. After the pressure jump, the flow velocity drops drastically. The intensity of the pressure jump between the cross-sections V and VI is intensified due to the increase of the stagnation pressure of the mixture in the nozzle 16. As indicated previously, the stagnation pressure in the nozzle 16 is increased because the passive fluid evaporates, and its energy is converted into potential energy.

Figure 5:
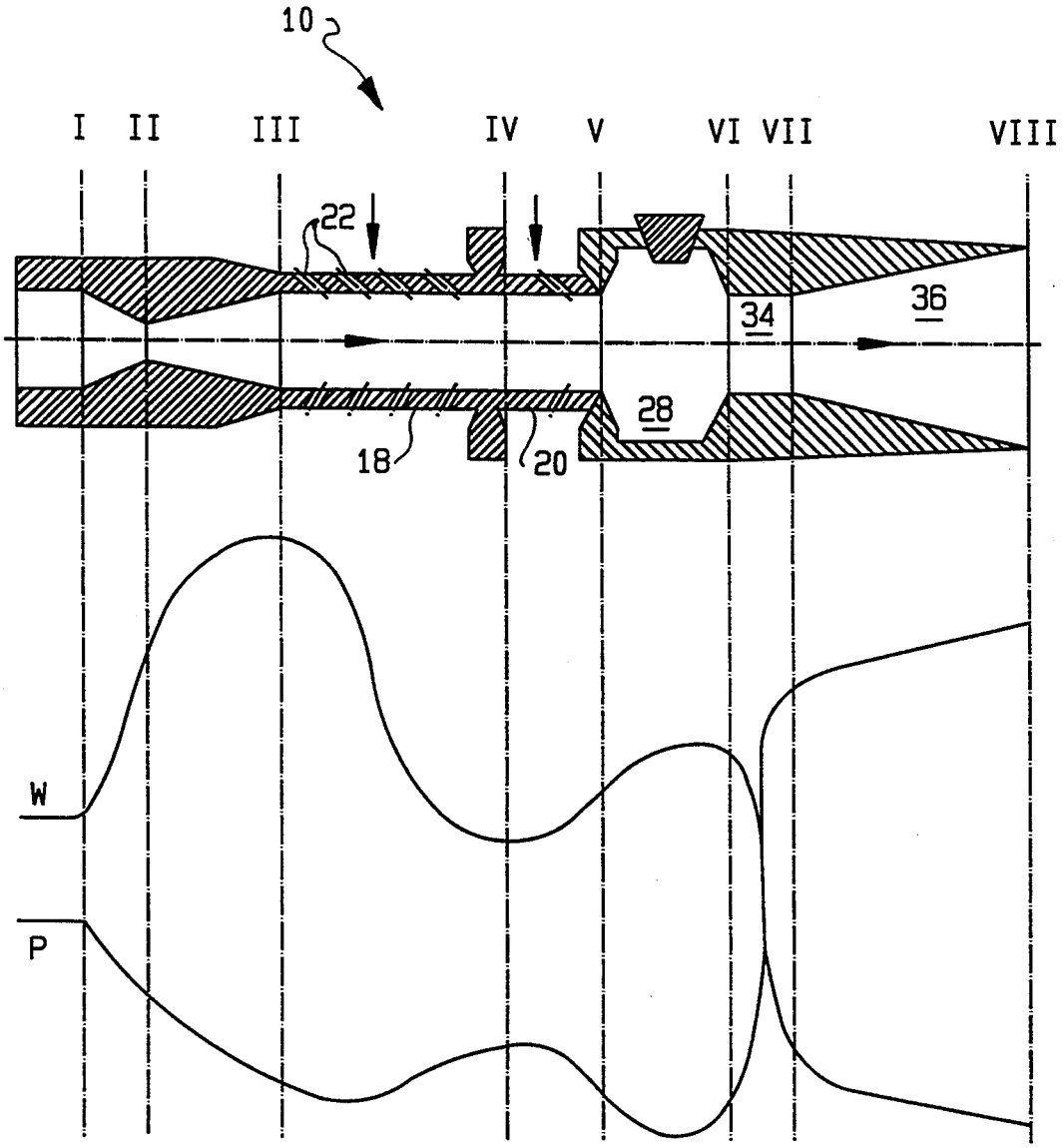
FIG. 5 is a cross-sectional schematic view of an alternative embodiment of the device of FIG. 2 and corresponding W and P curves.

The second example or alternative embodiment is discussed in connection with FIG. 5. In this example the geometry of the inlet portion (cross-sections I–III) of the device 10 has been modified such that the inlet portion widens between the cross-sections II–III. Otherwise, cross-sections III–VIII correspond to the beginning of the working section 18, the control section 20, the expansion chamber 28, the channel 34, the diffuser 36 and the outlet 38 respectively.

In this embodiment, the device 10 of this invention operates in connection with a system 58 where the pressure of steam (active fluid) at the inlet 42 is higher than the pressure of the passive fluid provided through the feedline 50, and the temperature of both active and passive fluids is high. This situation occurs when the device 10 is utilized as a feeding pump of a boiler. For example, in such a system 58, the steam in the boiler is employed for supplying the boiler with additional water, i.e the steam from the boiler is used to move the condensed water in the system back into the boiler. A pump, which is the device 10 of this invention, provides water to the boiler from the source which has high temperature and the steam circulating in the system acts as active fluid. In such a system the pressure of steam (active fluid) is greater than the pressure of water (passive fluid).

Initially the pressure of steam is great. In order to lower the pressure of steam entering the device 10 below the pressure of the water, the steam is expanded in the supersonic geometrical nozzle between the cross-sections I and III. After the passive fluid is provided to the working section 18 of the nozzle 16 between the cross-sections III and IV and mixed with the active fluid, the velocity of the flow decreases to its intrinsic subsonic velocity and remains subsonic at least until the cross-section V. Otherwise the fluid flows in the device 10 behave as described in connection with the previous example as shown in FIG. 4.

If the pressure in the nozzle 16 begins to rise between the cross-sections III and IV so that it prevents the supply of the sufficient amount of the passive fluid, the nozzle 16 can be implemented as a converging cone, as illustrated in connection with the subsequent example of FIG. 6.

Also in the first example of FIG. 4, the pressure of steam (active fluid) was low and the pressure of water (passive fluid) was great. Since in the first example, the pressure of steam was lower than the pressure of water, there was no need to reduce the pressure of steam substantially. In the example of FIG. 5, however, the pressure of steam is high so that it has to be expanded to a greater extent to reduce its pressure before the water is supplied.

In the next example, discussed in connection with FIG. 5, the device 10 is utilized when the active fluid is water (not steam), and the temperature of the active fluid is higher than the temperature of the passive fluid. For example, the temperature of the active fluid is in the range of 290°–310° and its pressure is 120–140 bars while the passive fluid has a somewhat lower pressure and a temperature in the range of about 260°–270°.

Figure 6:
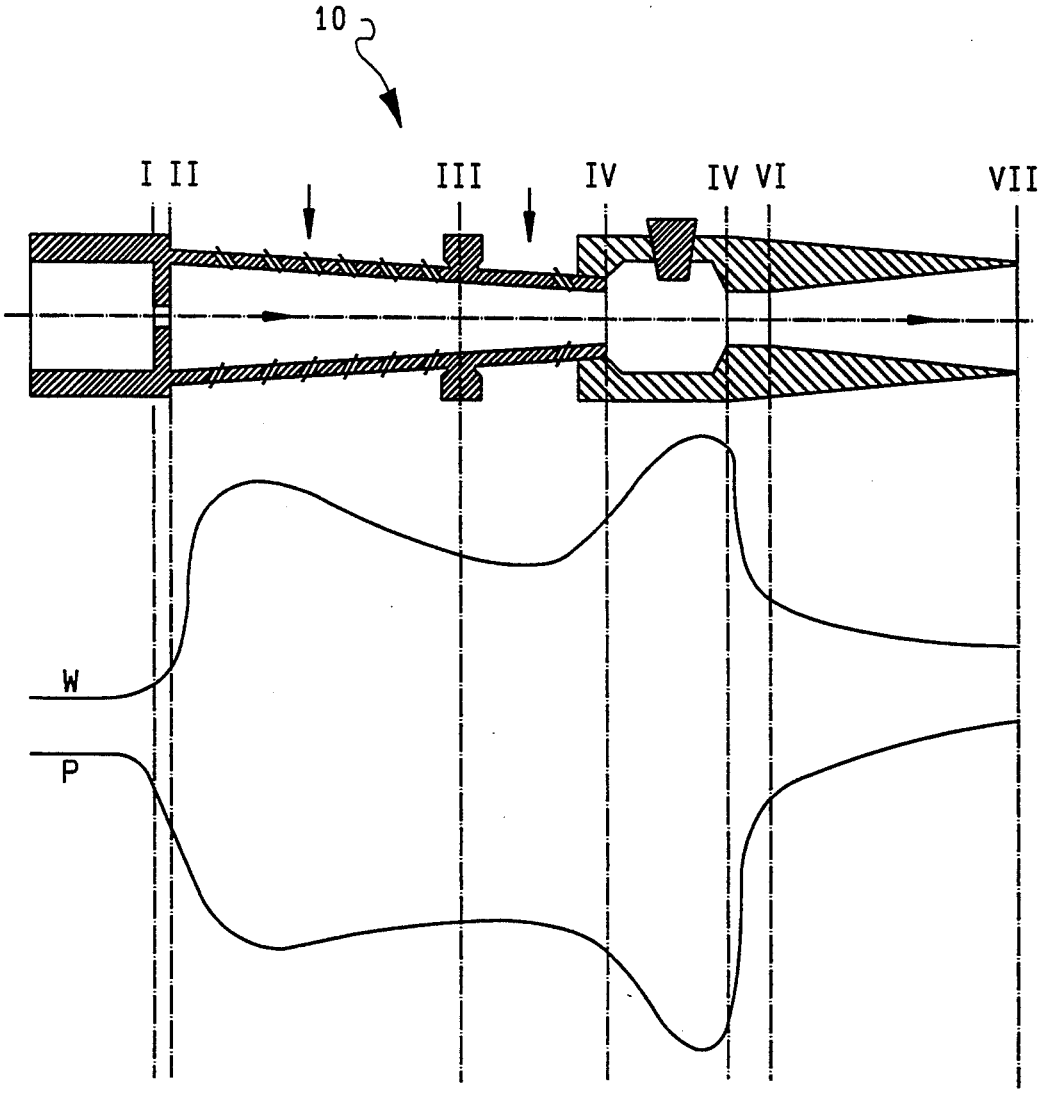
FIG. 6 is a cross-sectional schematic view of a second alternative embodiment of the device of FIG. 2 and corresponding W and P curves.

In the embodiment of the invention illustrated in FIG. 6, the active fluid is provided via a narrow opening (cross-sections I–II) and the cross-section of the nozzle 16 converges (from the cross-section II to the cross-section VI). Since hot liquid (active fluid) flows through the narrow opening, its pressure is drastically reduced at the cross-section II such that it is lower than the pressure of boiling of the active fluid at a given temperature. Also at this point the velocity of the active fluid rises to its sonic velocity. The passive fluid, which enters the working section (located between the cross-sections II–III) of the nozzle 16 (see FIG. 2), partially boils and exchanges motion components with the active fluid. After mixing with the passive fluid, the velocity of the mixture becomes subsonic. During the further motion of the mixture in the nozzle 16 the stagnation temperature drops and the related stagnation pressure rises.

In this embodiment the nozzle 16 has a conical shape as illustrated in FIG. 6 so that the increasing of the static pressure in the nozzle 16 does not inhibit the supply of the passive fluid. Otherwise, the processes that take place in the example of FIG. 6 from the cross-section III to the cross-section VII, are as described in conjunction with the first example shown in FIG. 4.

Figure 7:
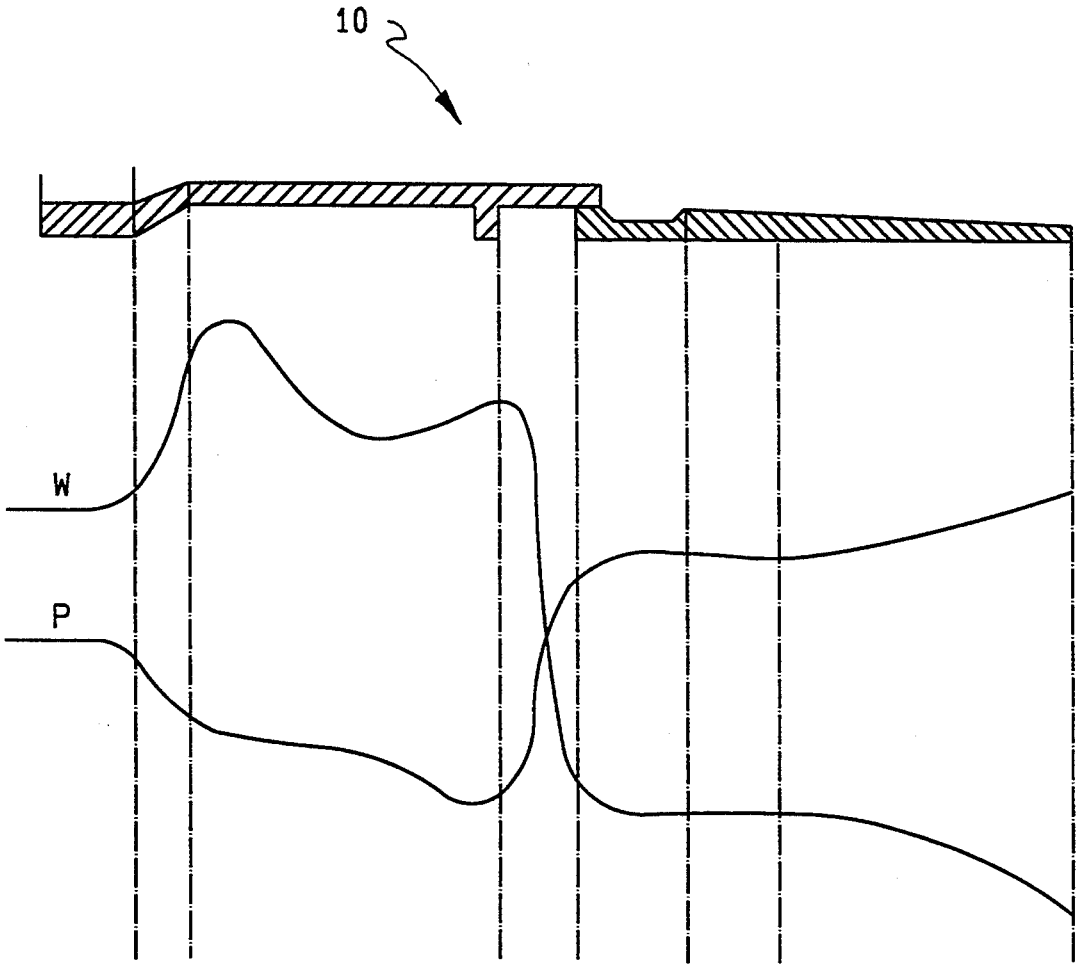
FIG. 7 is a cross-sectional schematic view of yet a third alternative embodiment of the device of FIG. 2 and corresponding W and P curves.

The last example of FIG. 7 illustrates a way of achieving a pressure jump in the device 10 which was considerably simplified. In essence it comprises only a conical working section 18 of the nozzle 16 located between the cross-sections II and III, and a portion having a constant cross section located between the cross-sections III and IV. In this embodiment the pressure jump is achieved between the cross-sections III and IV, without using the expansion chamber 28 or the outlet channel (i.e., without using a portion of the device between the cross-sections IV and VI). In this embodiment the device 10 is useful as for example a pump that does not require the precise parameters of the mixture at the outlet and it is not necessary to control the intensity of the pressure jump.

As illustrated between the cross-section of II and III the pressure of the mixture constantly drops. By selecting the proportions of the fluids properly, the speed of sound between these cross-sections drops such that the two-phase mixture becomes supersonic when it crosses the cross-section III. Thus, between the cross-sections III and IV, which is the channel of a constant cross-section, the pressure jump takes place. As in the previous examples of FIGS. 4, 5 and 6, in the working section 18 of the nozzle 16 the stagnation temperature is reduced and the stagnation pressure is increased.

It should be noted that in the geometrical method of effecting the pressure jump as described in the parent application, it is difficult to ensure the stable operation of the device 10 with low volumes of flow of the mixture, for example, less than 500 liters per hour. Such stable operation with the apparatus of the parent application is difficult since the dimensions that are required for the formulation of the pressure jump become very small, i.e., fractions of millimeters. This drawback is easy to remedy by using the device 10 of the present invention since the pressure jump can be controlled by adding mass in the control section 20. It is also significant that, as indicated, the variation of the parameters at the outlet of the device 10 does not effect the throughput of the device 10.

Thus from the analysis discussed in connection with FIG. 1, by employing the consumption nozzle 16, it is possible not only to control the magnitude of the pressure jump, but also to ensure the precise concentration of each of the fluids that are mixed in the device 10. Accordingly, the device 10 of the present invention can be advantageously employed for adjusting the doses of the mixture.

In summary, it should be noted that the method of effecting the pressure jump in a transonic flow of a diffused mixture of fluids by effecting the stagnation pressure prior to the pressure jump has wide applications. The ability to reduce the stagnation temperature in the flow of the mixture which is accompanied by the increase of the stagnation pressure, under the second law of thermodynamics, implies a more efficient conversion of the heat energy into work. A practical implication is that given the same parameters of the fluids at the inlet of the device 10 and the "consumption" influence (i.e., the addition of mass) on the flow of a diffused mixture one can obtain higher throughput of the mixture and/or the higher pressure at the outlet of the device in comparison to the purely geometrical design of the parent application. This is obtained due to the high compressibility of the homogenous diffused mixtures, as well as due to the specific characteristic of the dependency between the velocity of sound in the flow of a diffused mixtures and the mass, which dependency has a very sharp minimum at very low values of X.

Although the preferred embodiments of the present invention employ a direct cycle, the device 10 is also applicable to systems 58 employing a reverse cycle which will enable the effective utilization of the invention in systems related generally to air conditioning and cooling.

Variations of the above-described device 10 which involved minor changes are clearly contemplated to be within the scope of the present invention. In addition, minor variations in the design, angles or materials of the various components of the device 10 are also contemplated to be within the scope of the present invention. These modifications and variations may be made without departing from the spirit and scope of the present invention, as will become apparent to those skilled in the art. The specific embodiments described herein are offered by way of example only, and the invention is limited only by the terms of the appended claims.

What is claimed:

1. Device for increasing pressure in a multi-component fluid mixture comprising;

a. nozzle having a mixing section and a control section;

b. means for supplying at least a first fluid component to said mixing section of said nozzle;

c. means for supplying at least a second fluid component to said mixing section of said nozzle such that it mixes with said first fluid component to form a fluid mixture flowing with subsonic velocity;

d. means for supplying a predetermined amount of a third fluid component to said control section of said nozzle so as to intermix with said fluid mixture;

e. expansion means coupled in fluid communication with said nozzle for accelerating said intermixed fluid mixture; and f. outlet means coupled in fluid communication with said expansion means for increasing the pressure of said intermixed fluid.

2. Device for increasing pressure in a two-component fluid mixture comprising;

a. nozzle having an inlet, an outlet, a mixing section and a control section;

b. means for supplying a first fluid component to said mixing section through said inlet of said nozzle;

c. means for supplying a second fluid component to said mixing section of said nozzle such that it mixes with said first fluid component to form a two-phase mixture flowing with subsonic velocity;

d. means for supplying a predetermined amount of a third fluid component to said control section of said nozzle so as to intermix with said two-phase mixture;

e. expansion chamber coupled in fluid communication with said outlet of said nozzle for accelerating said intermixed fluid mixture; and f. outlet channel coupled in fluid communication with said expansion means, said outlet channel having a inlet of a cross-sectional area less than the cross-sectional area of the expansion chamber for accelerating said intermixed fluid to a supersonic velocity so as to create a pressure jump in said intermixed fluid.

3. The device of claim 2 further comprising a housing having an inlet and an outlet, said nozzle being disposed within said housing.

4. The device of claim 3 wherein said housing defines a mixing chamber disposed about said mixing section of said nozzle.

5. The device of claim 2 wherein said nozzle has a first plurality of perforations disposed in the wall portion of said nozzle disposed within said mixing chamber.

6. The device of claim 5 wherein said means for supplying a second fluid component is a second conduit adapted for being coupled to a source of said second fluid component.

7. The device of claim 6 further comprising a second slide valve coupled to said second conduit for regulating the supplying of said second fluid component to said mixing chamber.

8. The device of claim 2 wherein said housing defines a control chamber disposed about said control section of said nozzle.

9. The device of claim 8 wherein said nozzle has a second plurality of perforations disposed in the wall portion of said nozzle disposed within said control chamber.

10. The device of claim 9 wherein said means for supplying a third fluid component is a third conduit adapted for being coupled to a source of said third fluid component.

11. The device of claim 10 further comprising a third slide valve coupled to said third conduit for regulating the supplying of said third fluid component to said control chamber.

12. The device of claim 2 wherein said nozzle is a generally cylindrical elongated hollow member having an inlet disposed adjacent said mixing section and an outlet disposed adjacent said control section.

13. The device of claim 12 wherein said means for supplying a first fluid component is a first conduit adapted for being coupled to a source of said first fluid component.

14. The device of claim 13 further comprising a first slide valve coupled to said first conduit for regulating the supplying of said first fluid component to said mixing section.

15. The device of claim 14 wherein said expansion chamber is coupled to said outlet of said nozzle and at least a portion of said expansion chamber has a cross-sectional area at least greater than the cross-sectional area of said outlet of said nozzle.

16. The device of claim 15 further comprising a fourth conduit coupled to said expansion chamber so as to allow for predetermined relief of pressure from said expansion chamber.

17. The device of claim 16 further comprising a fourth slide valve coupled to said fourth conduit for regulating the relief of pressure from said expansion chamber.

18. The device of claim 2 wherein said outlet channel has a generally uniform cross-sectional area.

19. Device for increasing pressure in a two-component fluid mixture comprising;

a. nozzle having an inlet, an outlet, a mixing section and a control section;

b. means for supplying a first fluid component to said mixing section of said nozzle;

c. means for supplying a second fluid component to said mixing section of said nozzle such that it mixes with said first fluid component to form a two-phase mixture flowing with subsonic velocity, so as to increase the stagnation pressure of the two-phase mixture while decreasing its stagnation temperature;

d. means for supplying at least one of a predetermined amount of a third fluid component to said control section of said nozzle so as to intermix with said two-phase mixture;

e. expansion chamber coupled in fluid communication with said outlet of said nozzle for accelerating said intermixed fluid mixture; and f. outlet channel coupled in fluid communication with said expansion means, said outlet channel having a inlet of a cross-sectional area less than the cross-sectional area of the expansion chamber for accelerating said intermixed fluid to a supersonic velocity so as to create a pressure jump in said intermixed fluid.

20. Method for increasing pressure in a multi-component fluid mixture, comprising;

a. supplying at least one passive fluid in a flowing active fluid so that the resultant mixture of said fluids has a subsonic velocity relative to the speed of sound in said mixture and such that the stagnation pressure is increased due to the decrease of stagnation temperature of said mixture; and b. accelerating said mixture to sonic, and then to supersonic velocity so as to obtain a pressure jump.

21. The method of claim 20 further comprising supplying a predetermined amount of an additional mass into said subsonic flow of said fluid mixture so as to obtain in said fluid mixture a predetermined volume ratio of gas and a mixture of gas and liquid phases.

22. The method of claim 21 further comprising evaporating at least a portion of said passive fluid supplied to said flowing active fluid.

23. The method of claim 22 wherein said evaporation of said passive fluid is obtained by heating said passive fluid due to the relatively high temperature of said active fluid.

24. The method of claim 22 wherein said evaporation of said passive fluid is achieved by lowering the pressure where said passive fluid is mixed with said active fluid to create said fluid mixture.

25. The method of claim 21 wherein said additional mass is supplied such that if the volume ratio of gas and a mixture of gas and liquid phases of said fluid mixture is greater than a predetermined value, then said mass is supplied at a temperature which is less than the temperature of said fluid mixture.

26. The method of claim 21 wherein said additional mass is supplied such that if the volume ratio of gas and a mixture of gas and liquid phases of said fluid mixture is less than a predetermined value, then said mass is supplied at a temperature which is greater than the temperature of said fluid mixture.

27. Method for increasing pressure in a two-component fluid mixture comprising;

a. providing a nozzle having a mixing section and a control section;

b. supplying a first fluid component to said mixing section of said nozzle;

c. supplying a second fluid component to said mixing section of said nozzle such that it mixes with said first fluid component to form a two-phase mixture flowing with subsonic velocity;

d. supplying at least one of a predetermined amount of a third fluid component to said control section of said nozzle so as to intermix with said two-phase mixture;

e. expanding said mixture in an expansion chamber coupled in fluid communication with said nozzle for accelerating said intermixed fluid mixture; and f. accelerating said intermixed fluid to a supersonic velocity so as to create a pressure jump in said intermixed fluid outlet channel coupled in fluid communication with said expansion chamber, said outlet channel having an inlet of a cross-sectional area less than the cross-sectional area of the expansion chamber.

* * * * *